US011970914B1

(12) United States Patent
McCormick

(10) Patent No.: US 11,970,914 B1
(45) Date of Patent: Apr. 30, 2024

(54) TOOL STRING TRANSPORTATION DEVICE

(71) Applicant: PETROMAC IP LIMITED, Auckland (NZ)

(72) Inventor: Stephen Peter McCormick, Auckland (NZ)

(73) Assignee: PETROMAC IP LIMITED, Auckland (NZ)

( * ) Notice: Subject to any disclaimer, the term of this patent is extended or adjusted under 35 U.S.C. 154(b) by 0 days.

(21) Appl. No.: 18/452,641

(22) Filed: Aug. 21, 2023

(30) Foreign Application Priority Data

Jun. 6, 2023 (AU) ..... 2023901795

(51) Int. Cl.
*E21B 17/10* (2006.01)
*E21B 17/046* (2006.01)

(52) U.S. Cl.
CPC ..... *E21B 17/1057* (2013.01); *E21B 17/0465* (2020.05)

(58) Field of Classification Search
CPC ..... E21B 23/08; E21B 23/14; E21B 17/1057; E21B 17/0465
See application file for complete search history.

(56) References Cited

U.S. PATENT DOCUMENTS 5,040,619 A * 8/1991 Jordan ..... E21B 43/119 166/241.1
7,395,881 B2 * 7/2008 McKay ..... E21B 17/1057 166/241.3
9,200,487 B2 * 12/2015 Draper ..... E21B 17/05
2008/0164018 A1 * 7/2008 Hall ..... E21B 17/1057 166/241.1
2012/0061098 A1 * 3/2012 Hall ..... E21B 17/10 166/241.1
2012/0145380 A1 * 6/2012 Draper ..... E21B 17/05 166/241.3
2021/0002966 A1 * 1/2021 Church ..... E21B 17/1057

* cited by examiner

*Primary Examiner* — David Carroll
(74) *Attorney, Agent, or Firm* — DANN, DORFMAN, HERRELL and SKILLMAN

(57) ABSTRACT

A device for transporting a tool string down a bore comprises a single unitary part mandrel comprising a connection at each end of the mandrel for in-line connection of the device in a tool string and a single unitary part annular body rotationally mounted to the mandrel to rotate relative to the mandrel about a longitudinal axis of the mandrel or tool string. A pair of wheels is rotationally mounted to the annular body to rotate relative to the mandrel on a rotational axis perpendicular to the longitudinal axis of the tool string. A collar is releasably coupled to the mandrel to allow for assembly of the annular body onto the mandrel from one end of the mandrel when the collar is disassembled from the mandrel and axially retain the annular body on the mandrel when the collar is assembled to the mandrel.

9 Claims, 5 Drawing Sheets

TOOL STRING TRANSPORTATION DEVICE

TECHNICAL FIELD

This invention relates to devices for use in transporting (conveying) a tool such as a sensor assembly along a bore such as a pipe, a wellbore or a cased wellbore, and in particular to devices for use in transporting tool strings in cased hole wellbores in wireline logging operations.

BACKGROUND

Hydrocarbon exploration and development activities rely on information derived from sensors which capture data relating to the geological properties of an area under exploration. One approach used to acquire this data is through wireline logging. Wireline logging is performed in a wellbore immediately after a new section of hole has been drilled, referred to as open-hole logging. These wellbores are drilled to a target depth covering a zone of interest, typically between 1000-5000 meters deep. A sensor package, also known as a "logging tool" or "tool-string" is then lowered into the wellbore and descends under gravity to the target depth of the wellbore well. The logging tool is lowered on a wireline—being a collection of electrical communication wires which are sheathed in a steel cable connected to the logging tool. The steel cable carries the loads from the tool-string, the cable itself, friction forces acting on the downhole equipment and any overpulls created by sticking or jamming. Once the logging tool reaches the target depth it is then drawn back up through the wellbore at a controlled rate of ascent, with the sensors in the logging tool operating to generate and capture geological data.

Wireline logging is also performed in wellbores that are lined with steel pipe or casing, referred to as cased-hole logging. After a section of wellbore is drilled, casing is lowered into the wellbore and cemented in place. The cement is placed in the annulus between the casing and the wellbore wall to ensure isolation between layers of permeable rock layers intersected by the wellbore at various depths. The cement also prevents the flow of hydrocarbons in the annulus between the casing and the wellbore which is important for well integrity and safety. Wireline logging is performed in cased hole to measure producing fluids, casing anomalies, cement bond integrity etc. There is a wide range of logging tools which are designed to measure various physical properties of the rocks and fluids contained within the rocks. The logging tools include transducers and sensors to measure properties such as electrical resistance, gamma-ray density, speed of sound and so forth. The individual logging tools are combinable and are typically connected together to form a logging tool-string. A wireline logging tool-string is typically in the order of 20 ft to 100 ft long and 1.4" to 5" in diameter.

The drilling of wells and the wireline logging operation is an expensive undertaking. This is primarily due to the capital costs of the drilling equipment and the specialised nature of the wireline logging systems. It is important for these activities to be undertaken and completed as promptly as possible to minimise these costs. Delays in deploying a wireline logging tool are to be avoided wherever possible.

One cause of such delays is the difficulties in lowering a tool string to the target depth of the wellbore. The tool string is lowered by the wireline down the wellbore under the force of gravity alone. The wireline, being flexible, cannot push the tool down the wellbore. Hence the operator at the top of the well has very little control of the descent of the tool string or its angular orientation in the bore.

The chances of a tool string failing to descend is significantly increased with deviated wells. Deviated wells do not run vertically downwards and instead extend downward and laterally at an angle from vertical. Multiple deviated wells are usually drilled from a single surface location to allow a large area to be explored and produced. As tool strings are run down a wellbore under the action of gravity, the tool-string will drag along the low side or bottom of the wellbore wall as it travels downwards to the target depth. The friction or drag of the tool-string against the wellbore wall can prevent to tool descending to the desired depth. The long length of a tool string can further exacerbate problems with navigating the tool string down wellbore.

With reference to FIG. 1, in deviated wells the weight of the tool-string exerts a lateral force (PW) perpendicular to the wellbore wall. This lateral force results in a drag force which acts to prevent the tool-string descending the wellbore. The axial component of tool-string weight (AW) acts to pull the tool-string down the wellbore and this force is opposed by the drag force which acts in the opposing direction. As the well deviation increases the axial component of tool weight (AW) reduces and the lateral force (PW) increases. When the drag resulting from the lateral force (PW) equals the axial component (AW) of tool-string weight the tool will not descend in the wellbore.

Friction may be reduced by using wheels. U.S. Pat. No. 9,200,487 describes a wheeled device for carrying a tool string down a well. The device comprises a mandrel configured to be connected in line in a tool string. A pair of wheels or rollers are rotationally mounted to an annular body. The annular body is mounted to the mandrel to rotate around the mandrel and longitudinal axis of the device and tool string. The rotating body allows the tool string to rotate on its longitudinal axis relative to the wheeled device. A pair of bearing assemblies made up of ball bearings set in annular grooves are provided between the body and the mandrel to provide a low friction interface between the body and mandrel. The tool string is eccentrically weighted so that angular orientation of the tool string in the well bore is achieved regardless of the angular position of the wheeled device within the bore.

US 2021/0002966 provides another example of an inline wheeled device for carrying a tool string down a well, with a pair of wheels mounted to an annular body rotationally mounted to an inline mandrel.

Space within the cross section of a bore is very limited, especially in small diameter casings. For example, a wheeled device for a 4" internal diameter casing may require a maximum outside diameter of 3" to fit through restrictions within the bore such as landing nipples. This leaves minimal accommodation space for an annular body carrying wheels on a mandrel and bearing arrangements between the wheels and body of the device. Bearings must be small to fit within the constrained space, reducing the load carrying capacity of the device and/or roller bearings may be substituted by plain bearings in order to fit within the available radial space. Plain bearings are less efficient than ball bearing with a higher friction coefficient.

A reference to any prior art in the specification is not, and should not be taken as, an acknowledgement or any form of suggestion that the prior art forms part of the common general knowledge in any country.

DISCLOSURE OF INVENTION

It is an object of the present invention to address any one or more of the above problems or to at least provide the industry with a useful device for transporting a tool string down a bore.

According to a first aspect of the present invention, there is provided a device for transporting a tool string down a bore, the device comprising:

- a mandrel formed as a single unitary part comprising a connection at each end of the mandrel for in-line connection of the device in a tool string;
- an annular body formed as a single unitary part, the annular body rotationally mounted to the mandrel to rotate relative to the mandrel about a longitudinal axis of the mandrel or tool string, and
- a pair of wheels rotationally mounted to the annular body to rotate relative to the mandrel on a rotational axis perpendicular to the longitudinal axis of the tool string, and
- a collar releasably coupled to the mandrel to allow for assembly of the annular body onto the mandrel from one end of the mandrel when the collar is disassembled from the mandrel and axially retain the annular body on the mandrel when the collar is assembled to the mandrel.

In some embodiments, the collar is configured to prevent an axial force applied to the collar in a direction towards the annular body from being transmitted to the annular body to allow the annular body to freely rotate relative to the mandrel about the longitudinal axis of the device.

In some embodiments, the collar presents a first axial shoulder and the mandrel comprises an oppositely facing mandrel axial shoulder, and wherein the annular body is axially retained between the collar first axial shoulder and the mandrel axial shoulder.

In some embodiments, the annular body axially floats between the first axial shoulder and the oppositely facing mandrel axial shoulder.

In some embodiments, the collar presents a second opposite axial shoulder against which an adjacent tool string section can bear in an axial direction without transmitting an axial force to the annular body thereby allowing the annular body to freely rotate relative to the mandrel about the longitudinal axis of the device.

In some embodiments, the device comprises at least one dog to axially couple the collar to the mandrel in an axial direction towards the annular body to transmit an axial force applied to the collar to the mandrel.

In some embodiments, the at least one dog prevents the axial force applied to the collar from being transmitted to the annular body.

In some embodiments, the collar is assembled to the mandrel to extend over and radially capture the at least one dog to thereby couple the collar to the mandrel in the axial direction.

In some embodiments, the mandrel comprises at least one groove to receive the at least one dog, and wherein the at least one dog acts against a side of the groove and an oppositely facing internal axial surface on the collar to axially engage the collar to the mandrel in the axial direction.

In some embodiments, in use the collar is captured axially between a connected tool string component and the at least one dog.

In some embodiments, the device comprises at least two dogs, and wherein the collar has a recess for receiving each dog, the recesses positioned to locate the dogs equi-spaced about the circumference of the mandrel.

In some embodiments, the at least one dog is a split ring comprising at least two parts.

In some embodiments, the mandrel comprises a said groove for receiving the split ring.

In some embodiments, the split ring extends partially around a circumference of the mandrel.

In some embodiments, the device comprises one or more fasteners to retain the collar on the mandrel and without transmitting a substantial axial force applied to the collar to the mandrel.

Unless the context suggests otherwise, the term "wellbore" or similar terms should be understood to also refer to a casing pipe within a wellbore. Thus, the term 'wellbore wall' may refer to the wall of a casing within a wellbore.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

The term "dog" has the usual engineering meaning of a component or part of a component that prevents relative movement between two objects through physical engagement.

Where in the foregoing description, reference has been made to specific components or integers of the invention having known equivalents, then such equivalents are herein incorporated as if individually set forth.

The invention may also be said broadly to consist in the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

Further aspects of the invention, which should be considered in all its novel aspects, will become apparent from the following description given by way of example of possible embodiments of the invention.

BRIEF DESCRIPTION OF THE DRAWINGS

An example embodiment of the invention is now discussed with reference to the Figures.

BEST MODES FOR CARRYING OUT THE INVENTION

Figure 1:
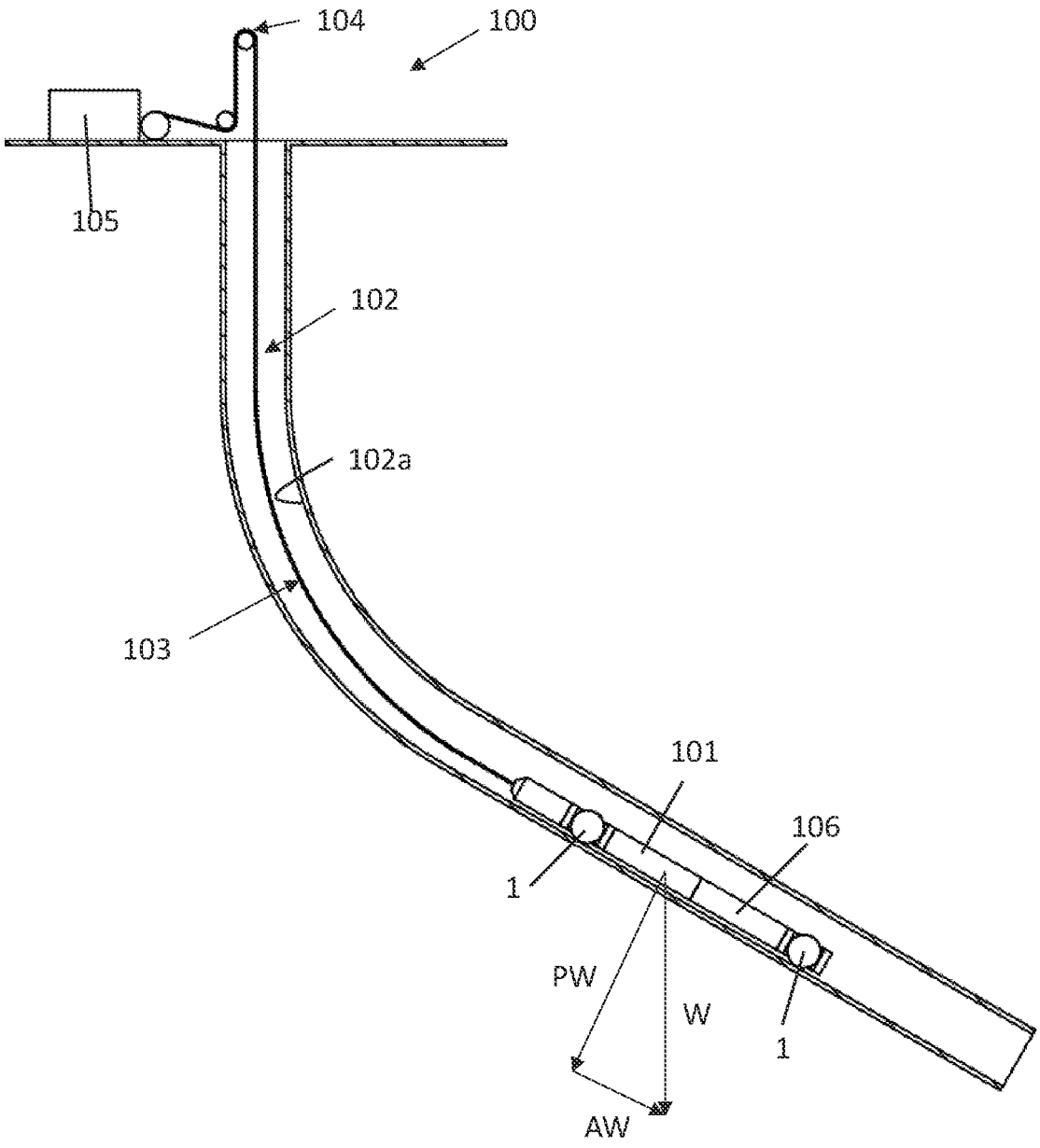
FIG. 1 is a schematic representation of a well site and a tool string descending a wellbore in a wireline logging operation.

Alternative embodiments of the invention are described. Same or similar parts are not described for every embodiment and are referenced in the drawings by the same reference numerals.

FIG. 1 provides a schematic representation of a well site 100. A logging tool string 101 is lowered down the wellbore 102 on a wireline 103. Wellsite surface equipment includes sheave wheels 104 typically suspended from a derrick and a winch unit 105 for uncoiling and coiling the wireline to and from the wellbore, to deploy and retrieve the logging tool 101 to and from the wellbore to perform a wellbore wireline logging operation. The logging tool string 101 may include one or more logging tools each carrying one or more sensors 106 coupled together to form the logging tool string 101. The wireline 103 includes at least one wire or cable to provide electrical power to the one or more sensors 106 and/or transmit sensor data to the wellsite surface. The tool string is transported down the wellbore by devices 1.

FIGS. 2A to 2K illustrate a device 1 for transporting a tool string on its wheels down a wellbore according to one embodiment of the invention. The device 1 comprises a connection sub or mandrel 2 (herein a mandrel). The mandrel 2 is configured for inline connection in a tool string and may comprise any connection interface known in the art at each end for connecting with a tool string. For example, the mandrel 2 has a connection thread at each end for engaging a corresponding thread on an adjacent tool string components such as a sensor. The device 1 may have a male thread at one end 4, e.g. a first end, and a female thread at an opposite end 5, e.g. a second end. The connections between the mandrel 2 and an adjacent tool string section may prevent relative rotation between the device 1 and the tool string.

The mandrel 2 of the device 1 has a through bore 21 extending the length of the mandrel 2 to allow for power and/or signal communication lines, i.e. electrical cables and/or hydraulic lines, or Primacord™ for perforating guns, to pass through the mandrel 2 and along the tool string. This allows for power and/or control signals from surface to extend to a tool string section located in the tool string below the device 1.

One or more circumferential grooves 19 may be provided to the mandrel 2 to receive annular seals (not shown) to provide a fluid tight circumferential seal between the device 1 and the adjacent tool string section. The illustrated embodiment has a pair of seal grooves 19. Alternatively, seals may be provided to the adjacent tool string section and the device 1 comprises a sealing face or surface to engage the seals.

An annular member or body 25 (herein 'body') is rotationally mounted to the mandrel 2 to rotate relative to the mandrel 2 about a longitudinal axis 15 of the device 2/tool string 101. The body is mounted axially between ends of the mandrel 2. For example, the body is axially between connection threads at each end of the mandrel. A pair of wheels 3 are rotationally mounted to the body 25. Each wheel 3 is mounted to the body 25 to rotate relative to the body and therefore the mandrel 2 on a rotational axis 14 (FIG. 2G) perpendicular to the longitudinal axis 15 of the device 1 or tool string 101. In the illustrated embodiment and as shown in FIG. 2G, the body 25 comprises a pair of sub axles 6, and each wheel 3 is rotationally mounted on a respective stub axle of the body 25. A bearing assembly 7 is provided between the wheel 3 and axle 6 to provide a low friction rotational coupling of the wheel 3 to the body 25. The bearing assembly 7 comprises rolling elements such as ball bearings or rollers. Alternatively, the bearing assembly may comprise plain bearings. The wheels are retained on the axles by fasteners or screws 8. In use the wheels contact the wellbore wall to carry the tool string down the wellbore to reduce friction between the tool string and bore wall.

Figure 2A:
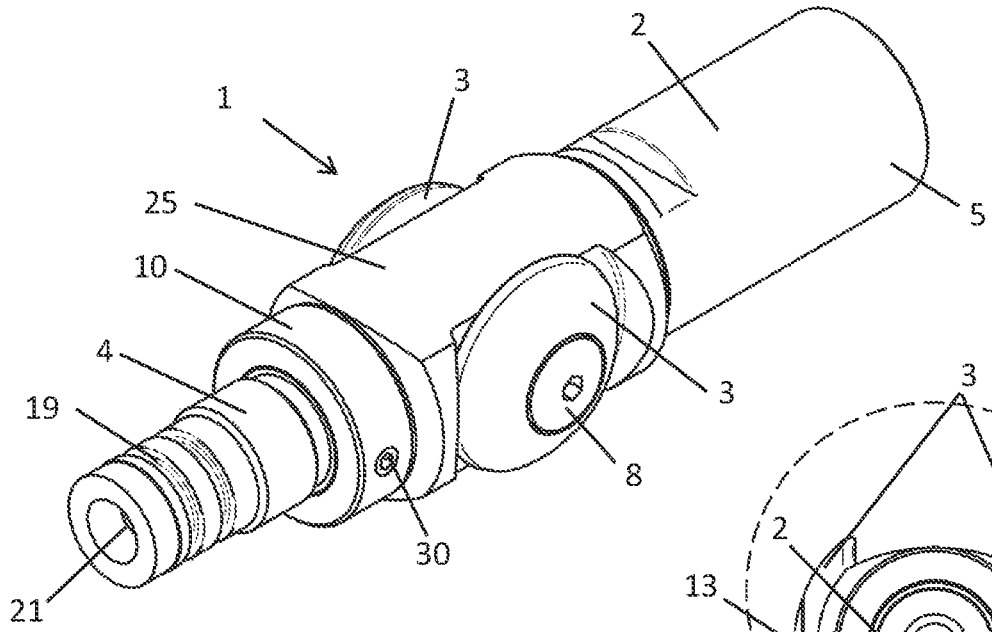
FIG. 2A illustrates a device for carrying a tool string down a well bore.
Figure 2B:
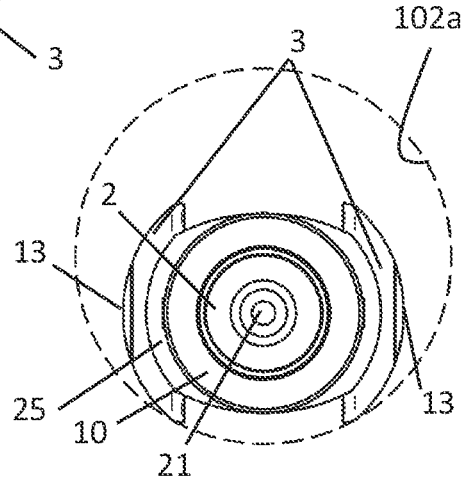
FIG. 2B is an end view of the device of FIG. 2A.
Figure 2C:
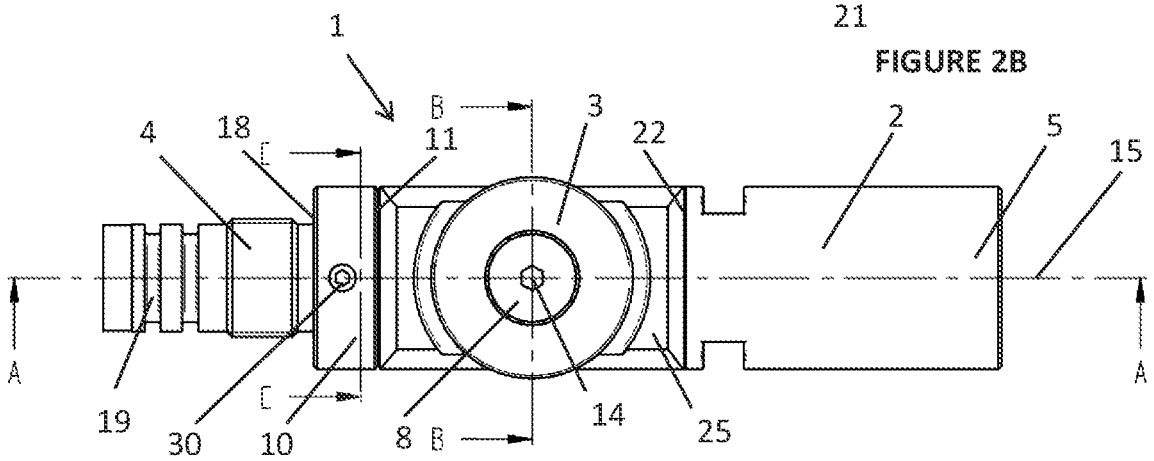
FIG. 2C is a side view of the device of FIG. 2A.
Figure 2D:
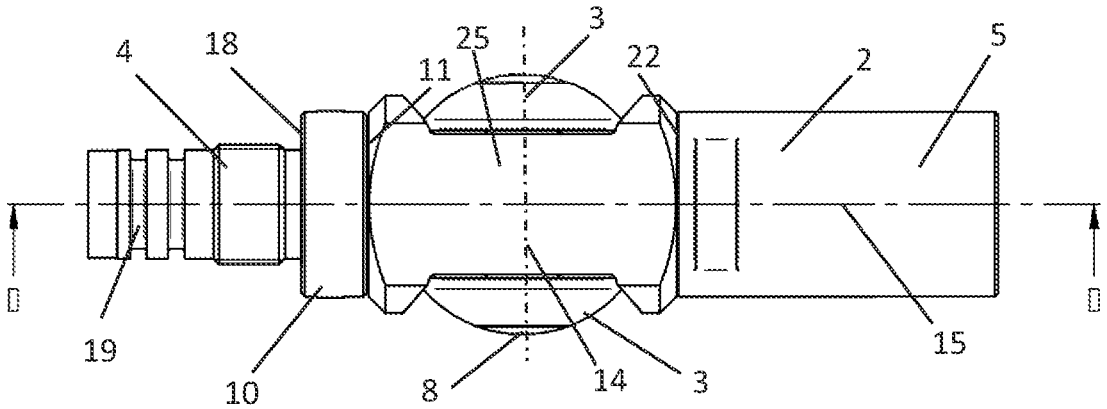
FIG. 2D is a top (or bottom) view of the device of FIG. 2A.
Figure 2E:
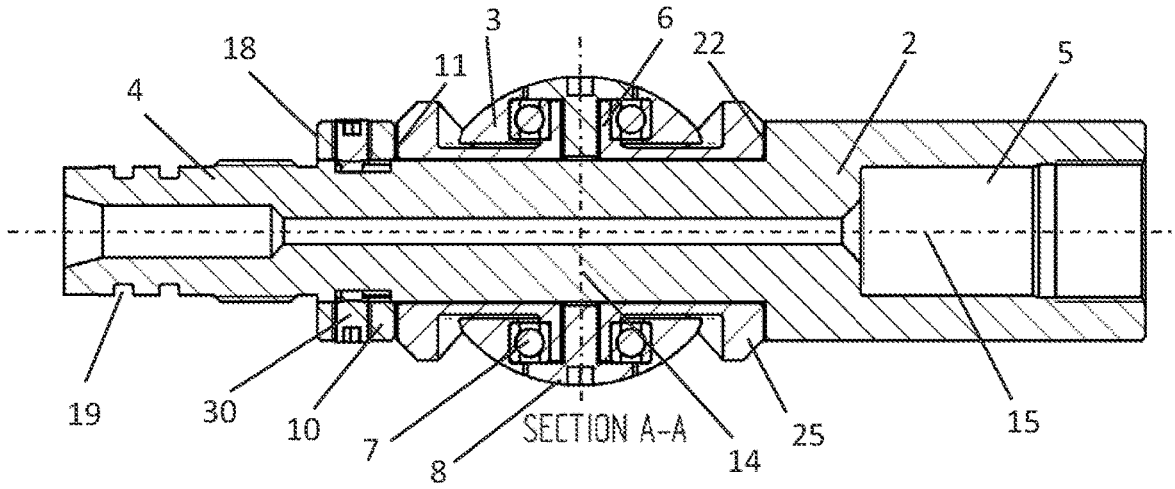
FIG. 2E is a sectional view on line AA in FIG. 2C.
Figure 2F:
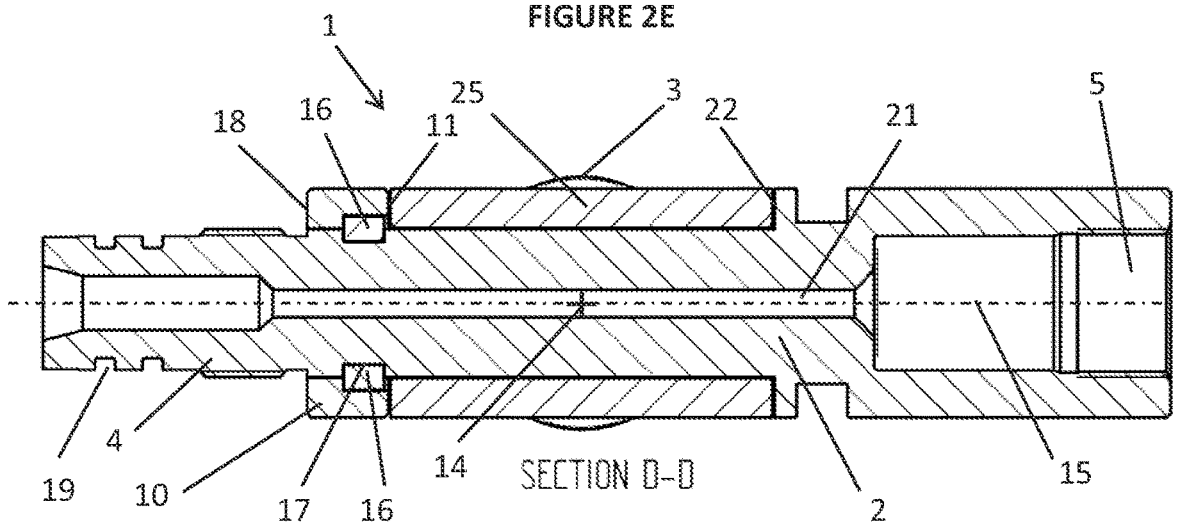
FIG. 2F is a sectional view on line DD in FIG. 2D.
Figure 2G:
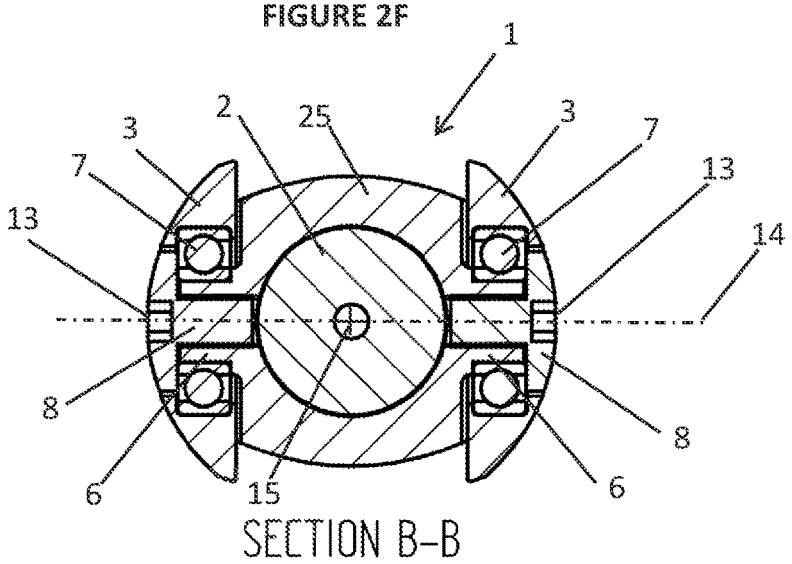
FIG. 2G is a sectional view on line BB in FIG. 2C.
Figure 2H:
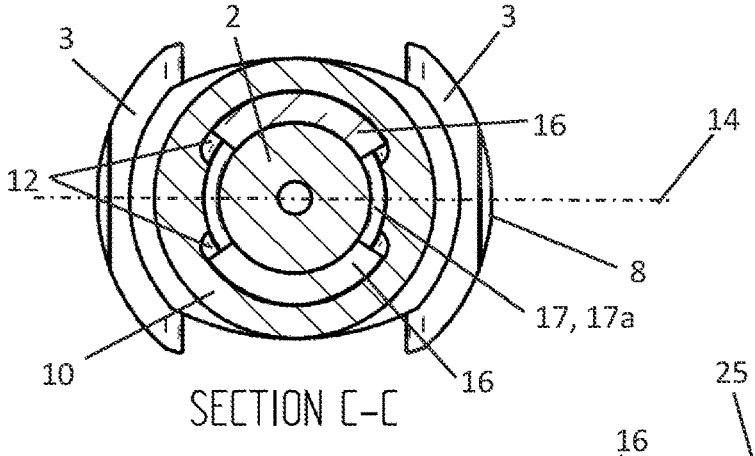
FIG. 2H is a sectional view on line CC in FIG. 2C revealing a pair of dogs 16 received in collar 10 to axially couple the member 10 to a mandrel 2 of the device.
Figure 2I:
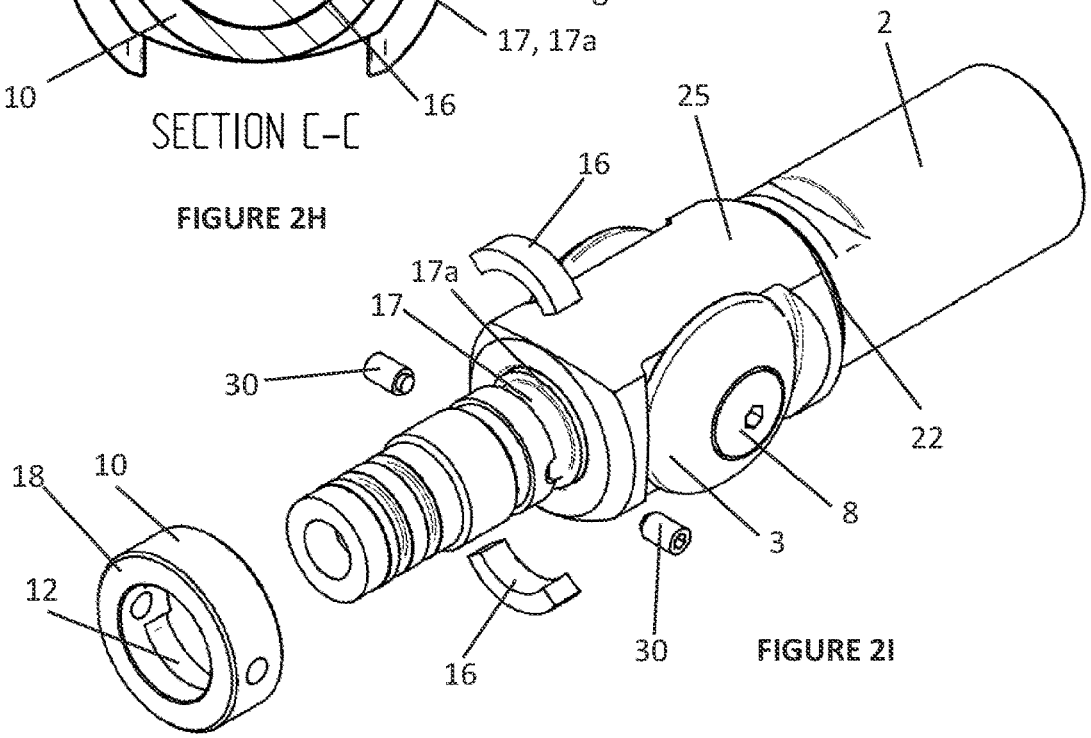
FIG. 2I illustrates the device of FIG. 2A but with the collar 10 removed from the mandrel 2 and the dogs 16 and fasteners 30 also disassembled.
Figure 2J:
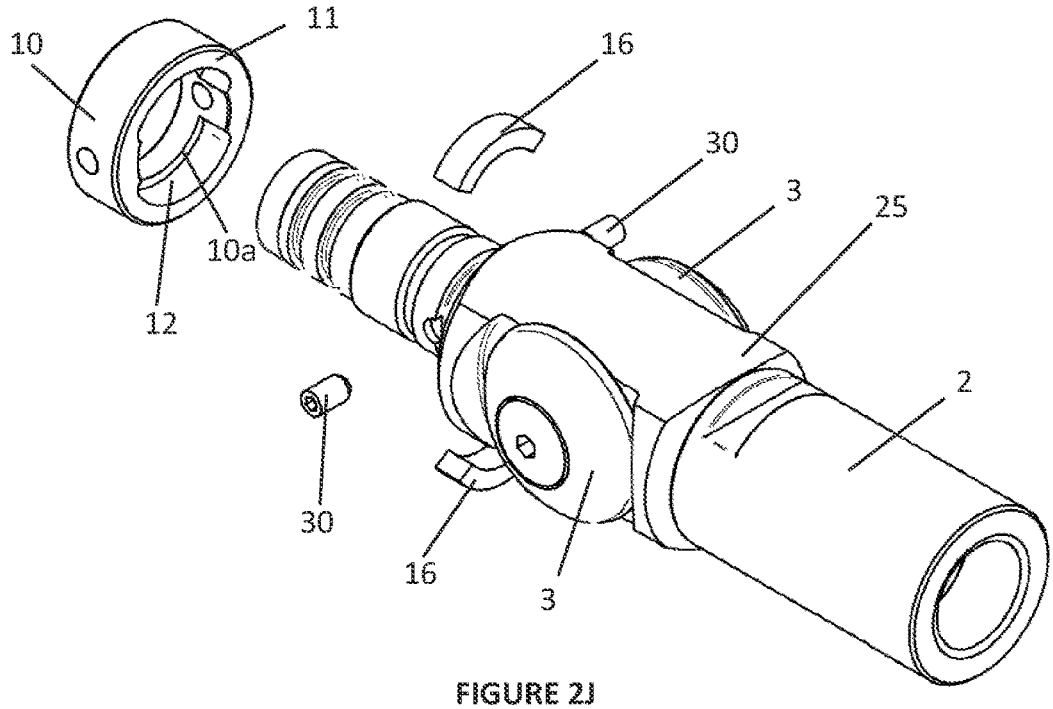
FIG. 2J illustrates the same as FIG. 2I but from a difference angle to reveal internal details of body 10, in particular recesses 12 for receiving dogs 16.

FIG. 2B presents an end view of the device 1 in a wellbore, shown in a horizontal orientation for clarity, with a radial extremity of the wheels (with respect to the rotational axis of the wheels) in contact with a low side of a wall 102*a* of the bore so that the device 1 is oriented to carry the tool string along the wellbore on the wheels 3 of the device 1.

As can be seen from FIGS. 2B and 2G, in the example illustrated embodiment, the device defines an outer form that orients the body 25 and wheels 3 of the device 1 in the bore during use so that the wheels 3 remain in contact the low side of the wall 102*a* of the bore 102. The outer form is a transverse outer form of the device 1, i.e. the outer form is defined by a lateral outline of the device 1 viewed in an end view of the device, as shown in FIG. 2B. In the illustrated example, the outer form of the device has a width greater than its height, or in other words is elongated in the width direction of the device. The width is in the direction of the rotational axis of the wheels. The height is in a direction perpendicular to the rotational axis of the wheels and the width direction. The outer form therefore orients the body and wheels so that the device is carried on the wheels. Should the device end up on its side with a lateral extremity 13 of the device in contact with the low side of the wellbore, the device will be unstable as the elongated width direction of the device will be vertical with the centre of gravity of the device/tool string furthermost from the low side of the wellbore. The centre of gravity of the device when connected to the tool string is at or near to the central axis 15 of the device 1. The device is most stable when the elongated width direction is horizontal, with the device supported on its wheels 3. In this stable position the centre of gravity of the device/tool string is closest to the bottom of the wellbore. Hence the mass of the device and the adjacent tool string is at the lowermost stable position.

In some embodiments, the device 1 may be connected in line with a weight bar of the tool string. The weight bar naturally moves to the lowest gravity position in the wellbore which is closest to the low side of the bore, with the body 25 rotating or swivelling on the mandrel 2 of the device 1 to maintain the axis of rotation 14 of the wheels 3 horizontal and the wheels 3 in contact with the low side of the bore.

In the illustrated embodiment the outer form of the device 1 has two orders of rotational symmetry about the longitudinal axis 15 of the device 1, to provide two stable positions with the device 1 supported on its wheels 3 in each stable position, i.e. the body 25 and wheels 3 can be rotated on the mandrel 2 on the central longitudinal axis 15 by 180 degrees to run either way up on the wheels 3. When connected in a tool string, the central longitudinal axis 15 of the device is coincident with the central longitudinal axis of the connected tool string section (such as a weight bar). The rotational axis 14 of the wheels 3 passes through the central axis 15, so that the regardless of which way up the device 1 is, the device remains centred on the central axis of the tool string section. The diameter of the wheels 3 is relatively large, i.e. the wheel diameter is greater than a maximum radial distance between the longitudinal axis 15 of the device and a lateral extremity of the device.

The illustrated embodiment has the body 25 received directly on the mandrel 2, forming a plain bearing arrangement. With no roller elements or the like required between the body 25 and the mandrel 2, a space saving is achieved which allows for the axles 6 and roller bearing elements 7 to be applied to the body 25 to support low friction rotation of the wheels 3. The stub axles 6 may be integrally formed with the body 25, i.e. the body with stub axles may be machined from a single blank or billet, or cast or 3D printed and machined post casting or printing.

In accordance with the present invention, the body 25 is formed as a single unitary part. The single unitary part 25 extends fully around a full circumference of the mandrel 2. Further in accordance with the present invention, the mandrel 2 comprising an inline connection at each end 4, 5 is also formed as a single unitary part. To assemble the single unitary part body 25 to the mandrel 2, the body 25 is slid onto the mandrel 2 from one end. In the illustrated embodiment, the mandrel has a male connection at one end 4 and a female connection at the other end 5, and the body 25 is slid onto the mandrel 2 from the male connector end to assemble the body 25 onto the mandrel 2.

The device comprises a collar 10 releasably coupled to the mandrel 2 to axially retain the body 25 on the mandrel 2. When the collar 10 is disassembled from the mandrel 2 the body 25 can be slid onto the mandrel 2 from one end of the mandrel 2, e.g. from the male end as described above. When the collar 10 is assembled to the mandrel 2 the collar axially retains the body 25 on the mandrel 2. The collar 10 presents an axial shoulder 11. The single unitary part mandrel 2 comprises an oppositely facing axial shoulder 22. The body 25 is axially retained between the collar axial shoulder 11 and the mandrel axial shoulder 22. The body axially 'floats' between the (first) axial shoulder 11 and the oppositely facing mandrel axial shoulder 22. For example, the length of the body 25 is slightly less than the axial distance between the shoulders 11, 22.

Figure 2K:
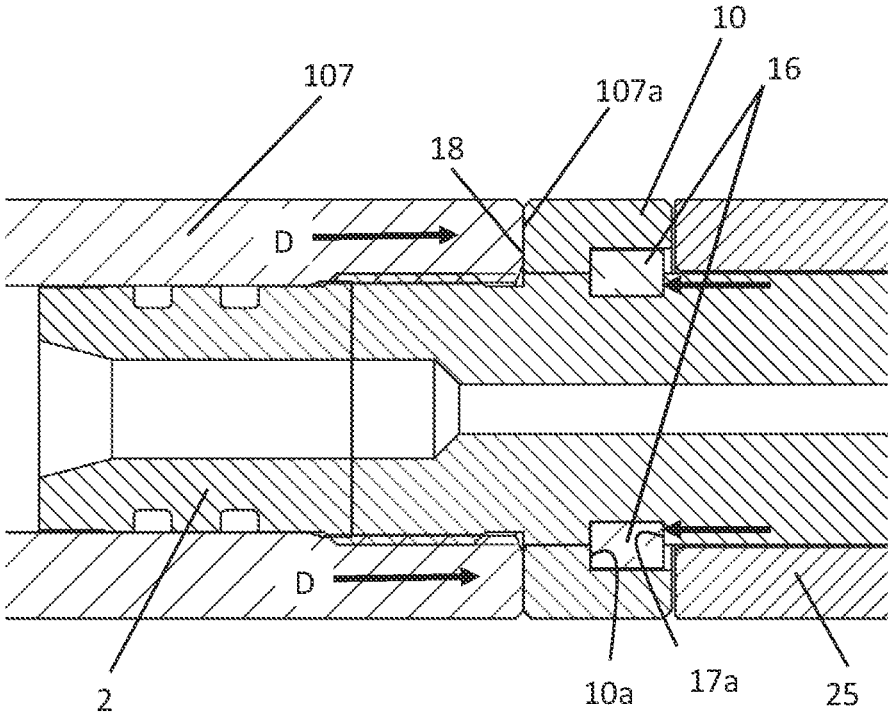
FIG. 2K is an enlarged sectional view on line DD in FIG. 2D including an adjacent tool string section connected to the end of the mandrel of the device.

In the illustrated embodiment, and with reference to FIGS. 2G to 2K, the device 1 has two dogs 16. The dogs 16 are received in a groove 17 (refer FIGS. 2F and 2I) in the mandrel 2. The collar 10 is assembled to the mandrel 2 to extend over the dogs 16 to radially capture and retain the dogs 16 in place on the mandrel 2 to couple the collar 10 to the mandrel in an axial direction. The dogs 16 act against a side 17*a* of the groove 17 and an oppositely facing (internal) axial surface 10*a* (refer FIG. 2J) on the collar 10, to axially engage the collar 10 to the mandrel 2 in an axial direction (D, FIG. 2K) towards the body 25. The collar 10, dogs 16 and side 17*a* of groove 17 thus transmit an axial force applied to the collar 10 in a direction towards the body 25 to the mandrel 2. This arrangement presents an axial shoulder 18 (the collar second axial shoulder) against which an adjacent tool string section (107 FIG. 2K) attached to the mandrel 2 can bear in an axial direction D. An axial force D applied to the collar via shoulder 18 is transmitted to the mandrel 2 and is not transmitted to the body 25, allowing the body 25 to freely rotate relative to the mandrel 2 about the longitudinal axis of the device. Axial force D applied to the collar via shoulder 18 is reacted at the body by the dogs acting against side of groove 17*a* as shown in FIG. 2K. As described above, the length of the body 25 is less than the axial distance between the shoulders 11, 22 such that an axial gap is presented between the shoulder 11 of the collar 10 and the body 25. This allows the body to axially float on the mandrel to freely rotate on the mandrel.

While the illustrated embodiment has a pair of dogs 16, one skilled in the art will appreciate the device may comprise one dog, or two or more dogs.

In the illustrated embodiment the pair of dogs are formed as a split ring 16. While the example embodiment has a split ring comprising two parts, the split ring may be provided in two or more parts. The parts in combination may extend partially around a circumference of the mandrel, i.e. the split ring extends partially and not fully around the mandrel. In the illustrated embodiment, each of the two parts extends less than 180 degrees around the mandrel 2.

The groove 17 in the mandrel 2 for receiving the dog(s)/split ring parts 16 may be an annular groove extending fully around the mandrel as shown or may be one or more grooves extending part way around the mandrel. The collar 10 has a recess 12 for receiving each dog/split ring part 16. The recesses 12 are positioned to locate the dogs/split ring parts 16 equi-spaced about the circumference of the mandrel 2. The recesses are spaced circumferentially apart around the longitudinal axis to position the dogs equi-spaced apart about the circumference of the mandrel.

An adjacent tool string component when coupled to the mandrel 2 may axially capture the collar 10 between the tool string component and the dog/split ring 16. The device 1 may comprise one or more fasteners to retain the collar 10 on the mandrel, see fastener 30, FIGS. 2A, 2E, 2I, 2J. The fastener 30 may retain the member 10 to prevent it falling off the mandrel 2 when the device is not connected inline to an adjacent tool string section. For example, the fasteners may be threaded fasteners such as grub screws or dog point grub screws 30. As shown in FIG. 2K, in use the collar 10 is captured axially between a connected tool string 107 component and the dogs 16 to transmit load applied by the tool string 107 to the mandrel 2 (and therefore not the body 25). The fasteners 30 may see no axial load or only a small axial load in use and thus only serve to ensure the collar and split ring remain assembled to the mandrel when not in use. The fasteners may be located circumferentially between adjacent dogs/split ring parts.

The present invention allows for both the body 25 and the mandrel 2 to each be manufactured as a single unitary part, resulting in significant benefits. Manufacturing costs are reduced. Machining the body in pieces, e.g. two halves is far more expensive due to the extreme precision required. The two halves are joined and must form a perfect circular bore that is precisely aligned. However, a single unitary part is easier to manufacture, the body can be made in a turning operation (on a lathe). Furthermore, a unitary body is stronger than a body assembled from two halves secured together by fasteners. A two-part body must have sufficient thickness to allow for fasteners to secure the two parts together, which consumes more space. The stronger unitary part body can be made with a thinner section, achieving a saving on space to provide more room for accommodating the wheels and bearings. Making the mandrel with end connections as a unitary part avoids the requirement for seals between assembled parts to seal the internal bore of the device from the surrounding ambient environment.

A device according to one or more aspects of the present invention as described above provides one or more of the following benefits.

- Reduced manufacturing costs, including required machining and assembly costs.
- Extremely robustness, the unitary body is much strong and can be made with a thinner section providing more space in which to provide high quality bearing arrangements to achieve the lowest possible friction.

A single unitary inline mandrel avoids the requirement for seals between assembled parts to seal the internal bore of the device from the surrounding ambient environment.

The heavy weight of the tool string is carried by wheels that have relatively larger diameter. Large diameter wheels reduce rolling friction, assisting travel of the device and tool string down hole, including in deviated bores.

Large diameter wheels also allow for efficient rolling elements to be used. Small diameter rollers or wheels present space constraints that makes using efficient roller bearings difficult or impossible.

The device is a passive device. No power input, such as electrical or hydraulic power provided from surface located power units is required.

The device is robust and provides a small number of moving parts reducing maintenance requirements and improving reliability.

The invention therefore provides a lower cost, effective, and simplified device that provides improved operational reliability.

The invention has been described with reference to device for transporting a tool string in a wellbore. However, a device according to the present invention may be used in other applications, for example to carry a camera along a pipe for inspection purposes.

Although this invention has been described by way of example and with reference to possible embodiments thereof, it is to be understood that modifications or improvements may be made thereto without departing from the spirit or scope of the appended claims.

The invention claimed is:

1. A device for transporting a tool string down a bore, the device comprising:

a mandrel formed as a single unitary part comprising a connection at each end of the mandrel for in-line connection to an adjacent component of a tool string;

an annular body formed as a single unitary part, the annular body rotationally mounted to the mandrel to rotate relative to the mandrel about a longitudinal axis of the mandrel or tool string, a pair of wheels rotationally mounted to the annular body to rotate relative to the mandrel on a rotational axis perpendicular to the longitudinal axis of the tool string, a collar releasably coupled to the mandrel, wherein the annular body is received on the mandrel between the collar and an axial shoulder on the mandrel, and at least one dog received in a groove in the mandrel, wherein a face of the dog bears against a side of the groove and an opposing face of the dog bears against an internal axial facing surface of the collar to axially engage the collar against the mandrel in an axial direction towards the annular body to transmit an axial force applied to the collar to the mandrel.

2. The device as claimed in claim 1, wherein a length of the annular body is less than an axial distance between the collar and the axial shoulder of the mandrel so that the annular body axially floats between the collar and the axial shoulder of the mandrel.

3. The device as claimed in claim 1, wherein the collar comprises at least one recess to receive the at least one dog so that the collar extends over and radially captures the at least one dog on the mandrel.

4. The device as claimed in claim 1, wherein the device comprises at least two dogs, and wherein the collar has a recess for receiving each dog, the recesses positioned to locate and space the dogs apart around a circumference of the mandrel.

5. The device as claimed in claim 1, wherein the at least one dog is a split ring comprising at least two parts.

6. The device as claimed in claim 5, wherein the split ring extends partially around a circumference of the mandrel.

7. The device as claimed in claim 1, wherein the device comprises one or more fasteners to retain the collar on the mandrel.

8. The device as claimed in claim 2, wherein the annular body freely rotates on the mandrel.

9. The device as claimed in claim 1, wherein the mandrel has a through bore extending the length of the mandrel for hydraulics, electrical cable, or perforating cord to pass through the device from end to end.

* * * * *